US010197067B2

(12) United States Patent
Ahn

(10) Patent No.: US 10,197,067 B2
(45) Date of Patent: Feb. 5, 2019

(54) ROTATION BODY OF ROTARY MACHINE AND METHOD OF MANUFACTURING THE ROTATION BODY

(71) Applicant: HANWHA AEROSPACE CO., LTD., Changwon-si (KR)

(72) Inventor: Sung-Chul Ahn, Changwon (KR)

(73) Assignee: HANWHA AEROSPACE CO., LTD., Changwon-si (KR)

( * ) Notice: Subject to any disclaimer, the term of this patent is extended or adjusted under 35 U.S.C. 154(b) by 1129 days.

(21) Appl. No.: 14/379,035

(22) PCT Filed: Feb. 13, 2013

(86) PCT No.: PCT/KR2013/001101

§ 371 (c)(1),
(2) Date: Aug. 15, 2014

(87) PCT Pub. No.: WO2013/122373

PCT Pub. Date: Aug. 22, 2013

(65) Prior Publication Data

US 2015/0017001 A1 Jan. 15, 2015

(30) Foreign Application Priority Data

Feb. 15, 2012 (JP) ..... 10-2012-0015532

(51) Int. Cl.

| | |
|---|---|
| ***F04D 29/40*** | (2006.01) |
| ***F04D 29/02*** | (2006.01) |
| ***F04D 29/22*** | (2006.01) |
| ***F04D 29/28*** | (2006.01) |

(52) U.S. Cl.

CPC ..... *F04D 29/403* (2013.01); *F04D 29/023* (2013.01); *F04D 29/2222* (2013.01);
(Continued)

(58) Field of Classification Search

CPC ..... F04D 29/2222; F05D 2230/31; B23K 26/342; Y10T 29/4932

USPC ..... 416/186 R

See application file for complete search history.

(56) References Cited

U.S. PATENT DOCUMENTS 5,889,254 A 3/1999 Jones
5,997,248 A * 12/1999 Ghasripoor ..... F01D 11/12 415/173.4

(Continued)

FOREIGN PATENT DOCUMENTS

JP 11148496 A 6/1999
JP 2004-169712 A 6/2004

(Continued)

OTHER PUBLICATIONS

Communication dated Dec. 23, 2015, by the State Intellectual Property Office of People's Republic of China in counterpart Application No. 201380009751.3.

(Continued)

*Primary Examiner* — Dwayne J White
*Assistant Examiner* — Brian O Peters
(74) *Attorney, Agent, or Firm* — Sughrue Mion, PLLC

(57) ABSTRACT

According to an aspect of an exemplary embodiment, there is provided a rotation body of a rotary machine, the rotation body comprising: an impeller comprising a blade; and a shroud that is integrally formed with the impeller and has a cladding stack structure in which a plurality of laser cladding layers are stacked.

8 Claims, 5 Drawing Sheets

(52) U.S. Cl.
CPC ..... *F04D 29/284* (2013.01); *F05D 2230/00* (2013.01); *F05D 2230/31* (2013.01); *Y10T 29/4932* (2015.01)

(56) References Cited

U.S. PATENT DOCUMENTS

| | | | | |
|---|---|---|---|---|
| 7,231,713 | B2 * | 6/2007 | Boegli | B23P 6/002 29/402.01 |
| 2005/0178750 | A1 * | 8/2005 | Cheng | B23K 26/147 219/121.64 |
| 2007/0003416 | A1 * | 1/2007 | Bewlay | B22F 5/009 416/241 B |
| 2007/0079507 | A1 | 4/2007 | Cheng et al. | |
| 2008/0237195 | A1 | 10/2008 | Iwasa et al. | |
| 2011/0200439 | A1 | 8/2011 | Nakaniwa et al. | |
| 2011/0318183 | A1 | 12/2011 | Noronha et al. | |

FOREIGN PATENT DOCUMENTS

| | | | |
|---|---|---|---|
| JP | 2007-107519 | A | 4/2007 |
| JP | 2008-240584 | A | 10/2008 |
| JP | 2010-203365 | A | 9/2010 |
| KR | 10-2011-0080889 | A | 7/2011 |

OTHER PUBLICATIONS

International Search Report dated May 14, 2013 issued in International Application No. PCT/KR2013/001101 (PCT/ISA/210/220).
Written Opinion dated May 14, 2013 issued in International Application No. PCT/KR2013/001101 (PCT/ISA/237).

* cited by examiner

[Fig. 1]
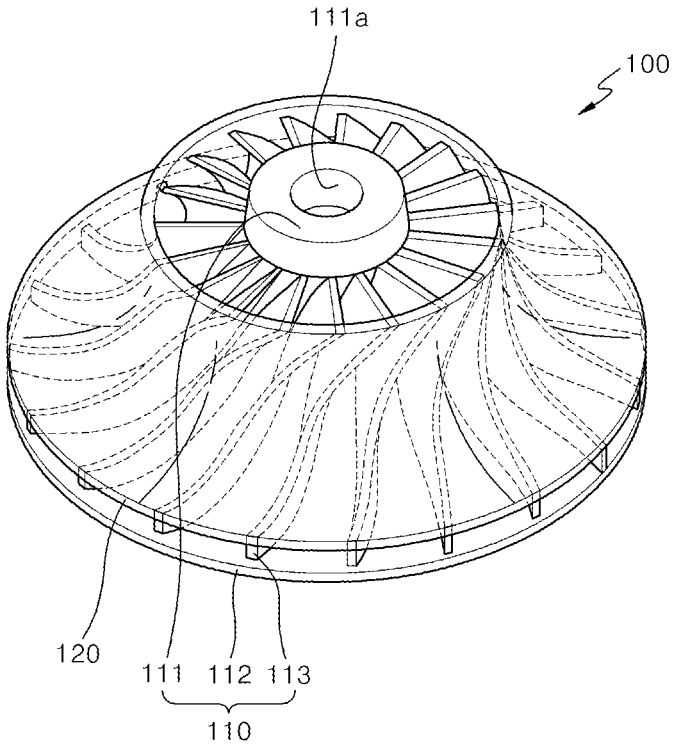
[Fig. 2]
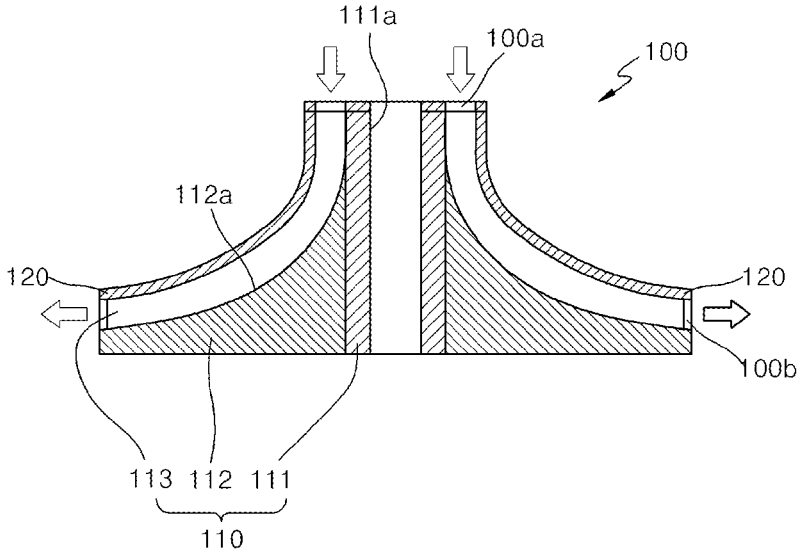

[Fig. 3]
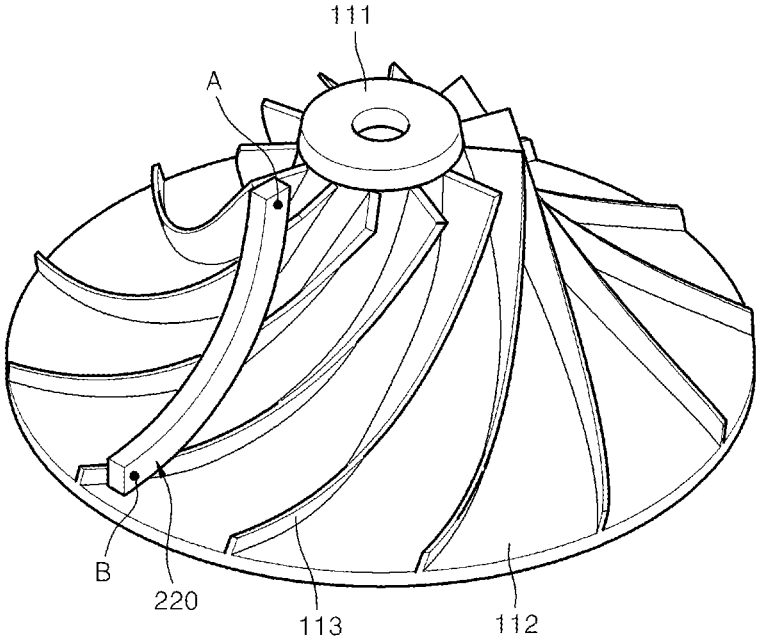
[Fig. 4]
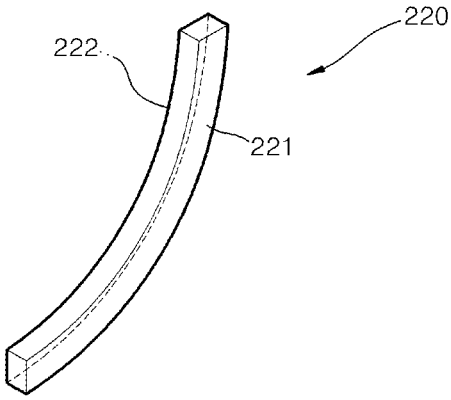

[Fig. 5]
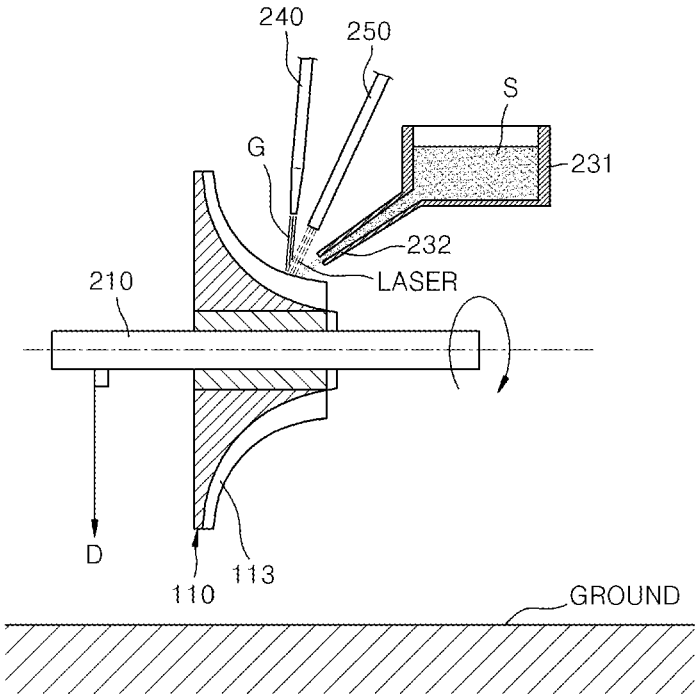
[Fig. 6]
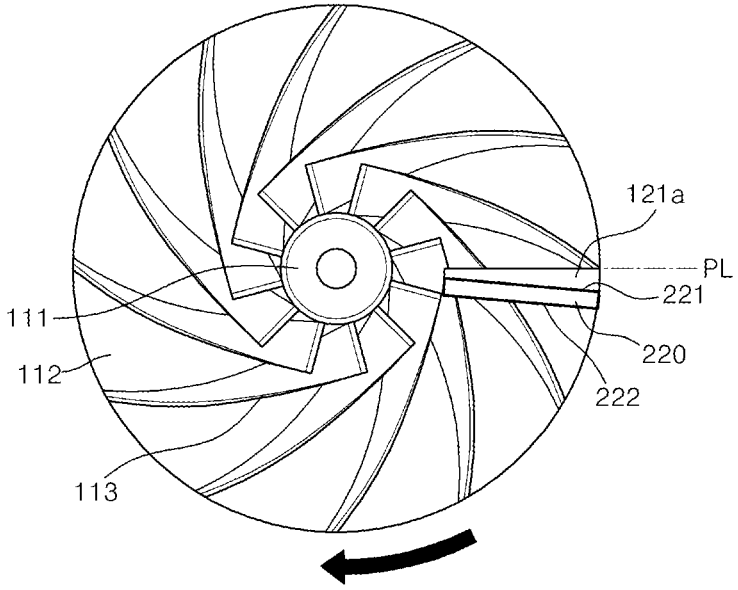

[Fig. 7]
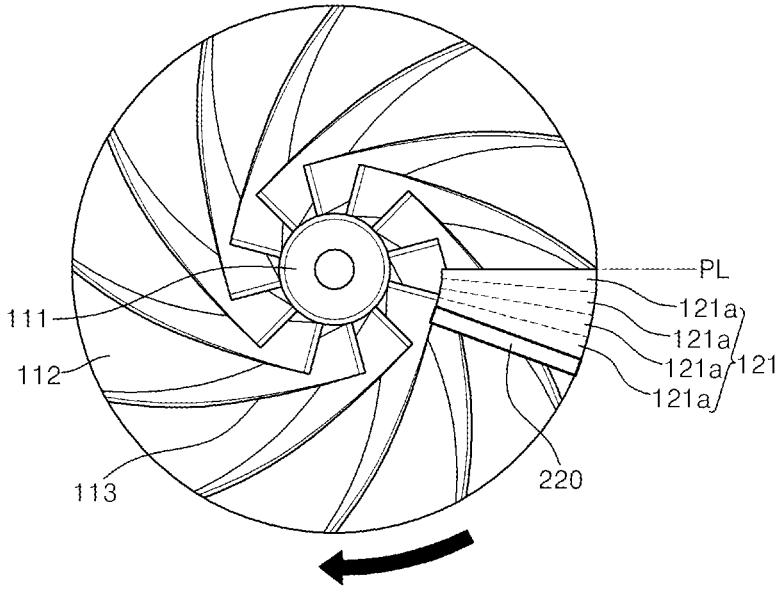
[Fig. 8]
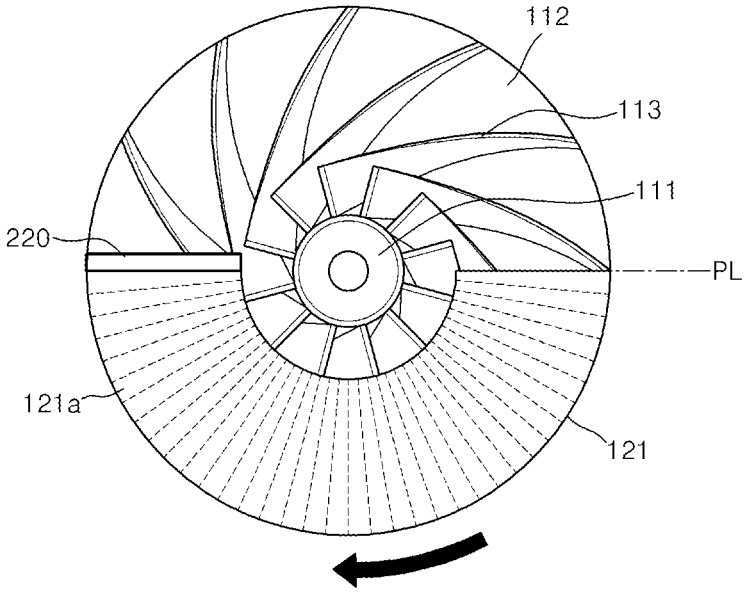

[Fig. 9]
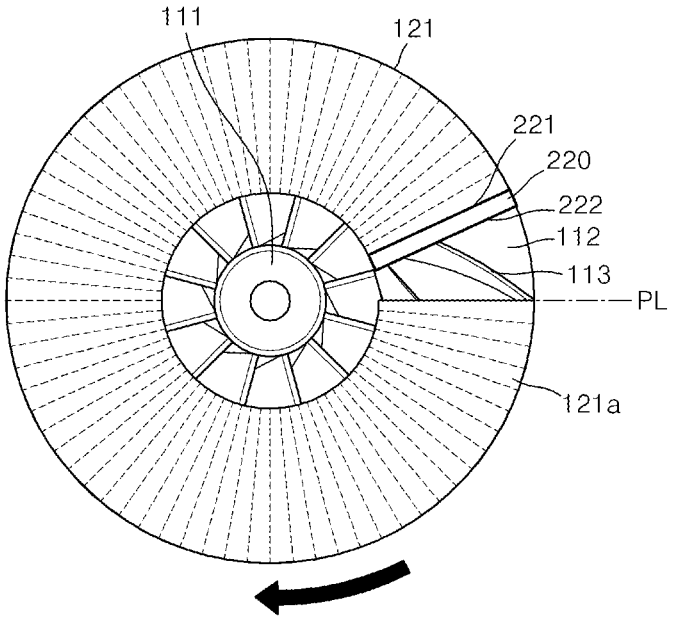

ROTATION BODY OF ROTARY MACHINE AND METHOD OF MANUFACTURING THE ROTATION BODY

TECHNICAL FIELD

Exemplary embodiments relate to a rotation body of a rotary machine and a method of manufacturing the rotation body, and more particularly, to a rotation body of a rotary machine, such as a compressor or a pump, and a method of manufacturing the rotation body.

BACKGROUND ART

A compressor that compresses a fluid, or a pump generally has a structure of a rotary machine including a rotation body therein.

Generally, such a rotary machine includes an impeller as a rotation body, wherein the impeller is configured to increase the pressure of a fluid by transferring rotary motion energy to the fluid. Accordingly, the impeller includes a plurality of blades for helping the flow of the fluid and transferring energy to the fluid.

A shroud is disposed outside the impeller to form a flow path of the fluid along with the blades.

Generally, since the efficiency of the compressor increases as intervals between the blades and the shroud decrease, the shroud has been recently manufactured by being combined with the impeller to thereby increase the efficiency of the compressor.

DISCLOSURE OF INVENTION

Technical Problem

When the shroud is combined with the impeller, the blades of the impeller and the shroud need to be mutually fixed, but several operations are used to mutually fix them. For example, Korean Patent Publication No. 2011-0080889 discloses a method of mutually fixing blades and a shroud via welding.

Solution to Problem

One or more exemplary embodiments provide a rotation body and a method of manufacturing the same, which have reduced manufacturing costs.

According to an aspect of an exemplary embodiment, there is provided a rotation body of a rotary machine, the rotation body comprising: an impeller comprising a blade; and a shroud that is integrally formed with the impeller and has a cladding stack structure in which a plurality of laser cladding layers are stacked.

Advantageous Effects of Invention

According to the exemplary embodiments, the rotation body may be manufactured with low manufacturing costs, high precision, and high durability.

BRIEF DESCRIPTION OF DRAWINGS

The above and other aspects will become more apparent by describing in detail exemplary embodiments thereof with reference to the attached drawings in which:

FIG. 1 is a perspective view schematically illustrating a rotation body of a rotary machine, according to an exemplary embodiment;

FIG. 2 is a cross-sectional view of the rotation body of FIG. 1;

FIG. 3 is a perspective view of the rotation body during an initial process of installing a stack support from among processes of manufacturing the rotation body, according to an exemplary embodiment;

FIG. 4 is a perspective view schematically illustrating the stack support according to an exemplary embodiment;

FIG. 5 is a view schematically illustrating a method of manufacturing a rotation body of a rotary machine, according to an exemplary embodiment; and FIGS. 6 through 9 are plan views illustrating a method of manufacturing a rotation body of a rotary machine, according to an exemplary embodiment

BEST MODE FOR CARRYING OUT THE INVENTION

According to an aspect of an exemplary embodiment, there is provided a rotation body of a rotary machine, the rotation body comprising: an impeller comprising a blade; and a shroud that is integrally formed with the impeller and has a cladding stack structure in which a plurality of laser cladding layers are stacked.

The rotary machine may be a compressor or a pump.

According to another aspect of an exemplary embodiment, there is provided a method of manufacturing a rotation body comprising an impeller that comprises a blade, and a shroud that is integrally installed on the impeller, the method comprising: preparing the impeller comprising the blade; and forming the shroud having a cladding stack structure by sequentially stacking laser cladding layers via a laser cladding process.

The forming of the shroud may comprise: fixing a stack support to the impeller; and forming the cladding stack structure by sequentially stacking the laser cladding layers on one surface of the stack support.

The method may further comprise: removing the stack support when the cladding stack structure reaches near an opposite surface of the one surface of the stack support; and filling a space where the stack support is removed with the cladding stack structure by re-starting to stack the laser cladding layers.

The forming of the shroud may comprise forming the cladding stack structure by sequentially stacking the laser cladding layers while rotating the impeller.

A direction of a rotation shaft of the impeller may be perpendicular to a direction of gravity.

The rotary machine may be a compressor or a pump.

Mode for the Invention

Hereinafter, one or more embodiments will be described in detail with reference to accompanying drawings. Also, in drawings, same reference numerals denote same elements to avoid repetition.

FIG. 1 is a perspective view schematically illustrating a rotation body 100 of a rotary machine, according to an exemplary embodiment, and FIG. 2 is a cross-sectional view of the rotation body 100 of FIG. 1.

The rotary machine according to the current embodiment is a compressor, and the rotation body 100 therein includes an impeller 110 and a shroud 120 as shown in FIGS. 1 and 2.

The rotary machine according to the current embodiment is a compressor, but is not limited thereto. In other words, the rotary machine may be an apparatus capable of changing pressure and speed of a fluid by using rotary motion of the rotary body 100. For example, the rotary machine may be a pump or a blower.

The impeller 110 includes an inner core 111, a base 112, and a plurality of blades 113. Here, the base 112 and the blades 113 may be formed of lightweight carbon steel or nonferrous metal, such as aluminum.

The inner core 111 may have a cylindrical shape.

An installation hole 111*a* is formed at a center of the inner core 111 and a rotation shaft 210 (refer to FIG. 5) is inserted into the installation hole 111*a* during an assembly process. Thus, the inner core 111 transfers power of the rotation shaft 210 to the impeller 110.

The base 112 is disposed outside the inner core 111, and here, a surface 112*a* of the base 112 not only smooths a fluid flow by having an inclining curved surface to form a bottom surface of a fluid path but is also designed to increase energy transference to the fluid.

The blades 113 are formed on the surface 112*a* of the base 112, and guide a flow of the fluid while transferring kinetic energy of the impeller 110 to the fluid.

The shroud 120 forms a ceiling surface of the fluid path to form the flow path of the fluid along with the base 112 and the blades 113.

The shroud 120 is combined with the top of the blades 113 to be integrally formed with the impeller 110, and has an umbrella shape having an opened center to cover the top of the blades 113.

The shroud 120 has a cladding stack structure 121 in which a plurality of laser cladding layers 121*a* are stacked on each other.

The laser cladding layer 121*a* is formed by supplying a cladding material (metal, ceramic, or the like) while irradiating a laser beam and melting the cladding material, as will be described later in detail.

A process of transferring energy to the fluid by using rotary motion of the rotation body 100 described above will now be described.

When the rotation body 100 rotates, the impeller 110 and the shroud 120 that is integrally formed with the impeller 110 also rotate.

The fluid flows into an inlet hole 100*a* of the rotation body 100 and is discharged from an outlet hole 100*b* at a high pressure upon receiving rotary kinetic energy of the rotation body 100, in a direction of arrows shown in FIG. 2. Then, the fluid passes through a diffuser (not shown) to reduce a speed thereof while increasing a pressure up to a desired point. Descriptions thereof are omitted herein.

Hereinafter, a method of manufacturing the rotation body 100, according to an exemplary embodiment, will be described with reference to FIGS. 3 through 9.

FIG. 3 is a perspective view of the rotation body 100 during an initial process of installing a stack support 220 among processes of manufacturing the rotation body 100, according to an exemplary embodiment, FIG. 4 is a perspective view schematically illustrating the stack support 220 according to an exemplary embodiment, FIG. 5 is a view schematically illustrating a method of manufacturing the rotation body 100 of the rotary machine, according to an exemplary embodiment, and FIGS. 6 through 9 are plan views illustrating a method of manufacturing the rotation body 100 of a rotary machine, according to an exemplary embodiment.

First, an operator prepares the impeller 110.

Then, the operator fixes the stack support 220 on the impeller 110 as shown in FIG. 3. The stack support 220 may be installed on ends of tips of the blades 113 via an adhesive or welding, or installed on an external jig at the top of the impeller 110.

The stack support 220 has a shape of a curved bar as shown in FIG. 4, wherein a curve of the curved bar is configured to include a curve of a cross section of the shroud 120. Here, a surface 221 of the stack support 220 is where the laser cladding layers 121*a* start to form and an opposite surface 222 is a surface opposite to the surface 221.

The stack support 220 is formed of the same material as the blades 113, and is adhered to the ends of the tips of the blades 113 via an adhesive or welding.

According to the current embodiment, the stack support 220 is formed of the same material as the blades 113, but the material of the stack support 220 is not limited thereto as long as the laser cladding layers 121 a are formed and stacked on each other.

Next, as shown in FIG. 5, the operator inserts the rotation shaft 210 into the installation hole 111*a* of the inner core 111, adjusts the direction of the rotation shaft 210 to be perpendicular to a direction D of gravity, and then rotates the rotation shaft 210 little-by-little at a predetermined angle so as to perform a laser cladding process.

Here, the laser cladding process is performed by ejecting cladding powder S stored in a hopper 231 through an ejection nozzle 232 while ejecting a protection gas G, such as argon gas, through a gas ejection nozzle 240, and irradiating a laser beam by using a laser irradiating apparatus 250.

The laser cladding process according to the current embodiment is performed by using the cladding powder S, but alternatively, the laser cladding process may be performed by using any cladding material, such as a wire or a foil.

Since well-known apparatuses and cladding materials may be used for the laser cladding process of the current embodiment, details thereof will not be described herein.

Also, in the current embodiment, the laser cladding process is performed by adjusting the direction of the rotation shaft 210 to be perpendicular to the direction D of gravity and then rotating the rotation shaft 210, but alternatively, the direction of the rotation shaft 210 may not be perpendicular to the direction D of gravity. However, if the direction of the rotation shaft 210 is perpendicular to the direction D of gravity, a part of the laser cladding layer 121*a* that melts and flows down during the laser cladding process may be prevented from dropping to the surface 112*a* of the base 112.

Hereinafter, performing the laser cladding process will now be described in detail.

First, as shown in FIG. 6, the laser cladding layer 121*a* is formed on the surface 221 of the stack support 220 via the laser cladding process.

Here, a work line PL is a location where a laser cladding apparatus is set and is a line where the laser cladding process is performed. Here, the direction of the laser cladding process in the work line PL is not specifically limited, and the laser cladding layer 121*a* may be formed from a point A to a point B or vice versa in FIG. 3.

Then, as shown in FIG. 7, the laser cladding process is performed on the work line PL while rotating the impeller 110 little-by-little at a predetermined rotation angle, wherein the top of the impeller 110 is covered by sequentially stacking the laser cladding layers 121*a* to gradually increase the size of the cladding stack structure 121. Here, a stack height direction of the laser cladding layers 121*a* is a circumferential direction of the impeller 110, and the predetermined rotation angle of the impeller 110 during the laser cladding process may be about 2° to 3° per rotation.

Next, the laser cladding process is continuously performed as described above to form the cladding stack structure 121 through to the state shown in FIG. 8 and to the state shown in FIG. 9. Here, in FIG. 8, the shape of the cladding stack structure 121 is almost a semicircle as the total sum of the predetermined rotation angles of the impeller 110 is about 180°.

Also in FIG. 9, the cladding stack structure 121 reaches near the opposite surface 222 opposite to the surface 221 of the stack support 220. Here, a distance between the cladding stack structure 121 and the opposite surface 222 of the stack support 220 may be sufficiently long so that the stack support 220 is removable.

Then, the operator removes the stack support 220 and then re-starts the laser cladding process to fill a space from where the stack support 220 was removed with the cladding stack structure 121, so as to form the shroud 120 covering the top of the blades 113, i.e., the top of the impeller 110.

According to the current embodiment, the shroud 120 is formed after removing the stack support 220, but alternatively, the shroud 120 may be formed by filling the cladding stack structure 121 up to the stack support 220 without removing the stack support 220.

During the laser cladding process described above, the ends of the tips of the blades 113 and the cladding stack structure 121 are naturally combined with each other. In other words, while forming the cladding stack structure 121, the bottom surface of the melted cladding stack structure 121 contacts the ends of the tips of the blades 113, and thus the cladding stack structure 121 and the blades 113 are combined with each other.

Then, the operator completes the forming of the shroud 120 by performing finish cutting machining in operation S104.

According to the current embodiment, finish cutting machining is performed to precisely form a shape of the shroud 120, but alternatively, the finish cutting machining may not be performed.

Also, in the current embodiment, the laser cladding apparatus is fixed and set, and the laser cladding process is performed on the work line PL while rotating the rotation shaft 210 installed on the impeller 110, but alternatively, the laser cladding process may be performed while moving the laser cladding apparatus without having to move the impeller 110.

As described above, according to the exemplary embodiments, manufacturing costs may be reduced compared to a general method where a shroud is separately manufactured and installed on an impeller, since the shroud 120 is formed through the cladding stack structure 121 formed by sequentially stacking the laser cladding layers 121*a* via the laser cladding process.

Also, according to the exemplary embodiments, since a laser cladding process that is capable of performing a highly precise process is used, the rotation body 100 may be manufactured at a high precision compared to when gas welding or electric welding is used, and the rotation body 100 may have a joining quality of high durability compared to brazing welding. Specifically, since the rotation body 100 may be formed with a high precision, the rotation body 100 may be easily manufactured even when the size of the rotation body 100 is small.

While the present invention has been particularly shown and described with reference to exemplary embodiments thereof, it will be understood by those of ordinary skill in the art that various changes in form and details may be made therein without departing from the spirit and scope of the present invention as defined by the following claims.

Industrial Applicability

According to an aspect of an exemplary embodiment, there is provided a rotation body of a rotary machine and a method of manufacturing the rotation body.

The invention claimed is:

1. A rotation body of a rotary machine, the rotation body comprising:

an impeller comprising a blade; and a shroud that is integrally formed with the impeller and has a cladding stack structure in which a plurality of laser cladding layers are stacked around an entire circumference of the impeller, wherein a stack height direction of the laser cladding layers is a circumferential direction of the impeller.

2. The rotation body of claim 1, wherein the rotary machine is a compressor or a pump.

3. A method of manufacturing a rotation body of a rotary machine comprising an impeller that comprises a blade, and a shroud that is integrally installed on the impeller, the method comprising:

preparing the impeller comprising the blade; and forming the shroud having a cladding stack structure by sequentially stacking laser cladding layers via a laser cladding process around an entire circumference of the impeller, wherein a stack height direction of the laser cladding layers is a circumferential direction of the impeller.

4. The method of claim 3, wherein the rotary machine is a compressor or a pump.

5. The method of claim 3, wherein the forming of the shroud comprises:

fixing a stack support to the impeller; and forming the cladding stack structure by sequentially stacking the laser cladding layers on one surface of the stack support.

6. The method of claim 5, further comprising:

removing the stack support when the cladding stack structure reaches near an opposite surface of the one surface of the stack support; and filling a space where the stack support is removed with the cladding stack structure by re-starting to stack the laser cladding layers.

7. A method of manufacturing a rotation body of a rotary machine comprising an impeller that comprises a blade, and a shroud that is integrally installed on the impeller, the method comprising:

preparing the impeller comprising the blade; and forming the shroud having a cladding stack structure by sequentially stacking laser cladding layers via a laser cladding process, wherein the forming of the shroud comprises forming the cladding stack structure by sequentially stacking the laser cladding layers while rotating the impeller.

8. The method of claim 7, wherein a direction of a rotation shaft of the impeller is perpendicular to a direction of gravity.

* * * * *